United States Patent [19]

Rider, Jr.

[11] Patent Number: 4,714,433

[45] Date of Patent: Dec. 22, 1987

[54] ELECTRICAL CONNECTOR WITH POSITION ASSURANCE AND DOUBLE LOCK

[75] Inventor: Frederick H. Rider, Jr., Youngstown, Ohio

[73] Assignee: General Motors Corporation, Detroit, Mich.

[21] Appl. No.: 5,607

[22] Filed: Jan. 21, 1987

[51] Int. Cl.[4] ..... H01R 13/639

[52] U.S. Cl. ..... 439/310; 439/357

[58] Field of Search ..... 339/75 R, 75 M, 91 R, 339/113 R

[56] References Cited

U.S. PATENT DOCUMENTS

| | | | |
|---|---|---|---|
| 3,713,076 | 1/1973 | Gabrielian et al. | 339/91 R |
| 4,010,998 | 3/1977 | Tolnar, Jr. et al. | 339/91 R |
| 4,070,081 | 1/1978 | Takahashi | 339/91 R |
| 4,082,400 | 4/1978 | Gansert | 339/91 R |
| 4,168,877 | 9/1979 | Little et al. | 339/91 R |
| 4,370,013 | 1/1983 | Niitsu et al. | 339/91 R |
| 4,435,033 | 3/1984 | Gansert et al. | 339/91 R |
| 4,634,204 | 1/1987 | Detter et al. | 339/91 R |
| 4,643,506 | 2/1987 | Kobler | 339/91 R |

*Primary Examiner*—John McQuade

*Attorney, Agent, or Firm*—Patrick M. Griffin

[57] ABSTRACT

A cooperating primary and secondary lock means used in combination with a pair of matable electrical connector bodies both assures that the connector bodies have reached the fully mated position, and double locks them together. Keeper projections on a cantilevered primary locking arm of the first connector body are engaged by the camming end of a rotatable secondary locking arm on the second connector body. This pulls the connector bodies together, if they were not fully mated, and as the camming end snaps beneath the keeper projections, full mating is indicated. The secondary locking arm thereby also captures the primary locking arm to provide a double lock.

3 Claims, 4 Drawing Figures

ELECTRICAL CONNECTOR WITH POSITION ASSURANCE AND DOUBLE LOCK

This application relates to electrical connectors in general, and specifically to an electrical connector having a pair of matable connector bodies with position assurance and cooperable double locking.

BACKGROUND OF THE INVENTION

Electrical connectors generally include first and second connector bodies of moldable insulating material, with internal conductive terminals. The connector bodies are mated together with a push or slide fit, which causes the internal terminals to make electrical contact. The connector bodies must be fully mated to assure proper electrical contact, and, preferably, are somehow locked together to assure that contact is not broken. This is especially important in high vibration environments, such as automobiles, which could shake the connector bodies apart.

One common type of lock between matable connector bodies is the cantilever arm type. A flexible arm cantilevered to the first connector body has a forward end that slidably moves over a ramp, or under a bar, on the second connector body as the two are pushed together, locking them together. An example of such a lock may be seen in U.S. Pat. No. 4,010,998 to Tolnar et al, assigned to the assignee of the present invention. One potential problem with this type of lock is that the connector bodies may require some force in order to push them together, and unless they are fully mated, the forward end of the locking arm will not be fully engaged, nor, as a consequence, will the lock be fully engaged. There is no readily apparent indicator to inform an operator or assembler that the connector bodies are, or are not, fully mated. This is especially true in the cramped and sometimes blind assembly locations involved in automobile assembly. Another shortcoming is that the lock is a single lock only, with no back up or redundancy feature, and is subject to being released if the arm is flexed up or down, as it could be in a high vibration environment. Also, the cantilever arm is typically exposed and unprotected above the surface of the connector bodies.

A design that speaks to one of the problems noted above, the lock release problem, may be seen in U.S. Pat. No. 4,370,013 to Niitsu et al. A separate lock disabling means is snap fitted to the second connector body, and simultaneously moves beneath the cantilever arm on the first connector body to disable the locking arm from being released. However, the lock disabling means is effective only after the connector bodies are fully mated, and it fits to the second connector body regardless of whether the two connector bodies are fully mated. The lock disabling means in Niitsu neither assures that the connector bodies are fully mated, nor does it provide any indication of whether they are or are and would be difficult to apply in a blind or inaccessible location.

SUMMARY OF THE INVENTION

The subject invention provides a cooperating primary and secondary lock means used in combination with first and second electrical connector bodies of the type described above that assures that, and provides a ready indicator that, the connector bodies are in fact fully mated, and which also provides double locking.

A primary lock means to retain the connector bodies together is provided by a cantilevered primary locking arm on the first connector body, and a latching member in the form of a ramp on the second connector body. The cantilevered locking arm extends from a base molded integrally to a planar surface of the first connector body to a forward latching end. The cantilevered arm is flexible about the base upwardly from a free state where it is generally parallel to the first connector body surface. The base further includes a keeper projection with a rounded surface that extends in the opposite direction to the locking arm. The ramp is integrally molded to a generally planar surface on the second connector body, and slopes upwardly. When the connector bodies are pushed together, the cantilever locking arm forward end slides along and up the ramp, which flexes the arm up. As the connector bodies reach their fully mated position, the locking arm forward end moves completely past the ramp sloped surface and flexes back down to its free state to provide a primary lock. Should the connector bodies not be completely pushed together, the locking arm forward end will rest on the ramp, rather than having moved past it, and the primary lock will not be fully engaged.

A secondary lock means cooperates with the primary lock means to assure that the connector bodies are properly and fully mated, and to give double locking. A secondary locking arm pivoted to the surface of the second connector body includes, in the preferred embodiment disclosed, a pair of side rails that are spaced apart greater than the width of the primary locking arm, and which extend from the pivot to a forward camming end that interconnects the side rails. The secondary locking arm is rotated by an operator about the pivot by pushing the camming end toward the second connector body. This can be done by feel only and with one hand, since the secondary locking arm is not a piece separate from the second connector body. So rotating the secondary locking arm eventually engages its camming end with the rounded surface of the keeper projection. Should the connector bodies be only partially mated, this engagement acts to move the the first connector body toward the second connector body, which assures that the forward end of the primary locking arm slides completely over the ramp and that the connector bodies reach the fully mated position. Continued pushing on the camming end snaps it beneath the keeper projection to indicate that the connector bodies have in fact reached the fully mated position. That snap fit also serves to capture the primary locking arm with the camming end, providing a double lock to retain the connector bodies together. The primary locking arm is located between the side rails, and both locking arms are close to the planar surfaces of the connector bodies, to give a compact, protected assembly.

It is, therefore, an object of the invention to provide, in combination with first and second matable electrical connector bodies, a cooperating primary and secondary lock means to assure and indicate that the connector bodies have reached the fully mated position, and to provide double locking between the connector bodies.

It is another object of the invention to provide such a cooperating primary and secondary lock means which includes a cantilevered primary locking arm on the first connector body and a pivoted secondary locking arm on the second connector body, and in which the secondary locking arm is rotated down to push the connector bodies fully together, if they are only partially mated, thereby capturing the primary locking arm to also provide a double lock.

It is yet another object of the invention to provide such a device in which the primary locking arm extends from a base that has a keeper projection extending in the opposite direction, and in which the secondary locking arm has a forward camming end that engages the keeper projection to move the first connector body toward the second connector body to assure that the connector bodies reach the fully mated position, and which then snaps beneath the keeper projection to indicate that the connector bodies have reached the fully mated position, thereby also capturing the primary locking arm base, whereby a double lock between the connector bodies is cooperatively provided.

DESCRIPTION OF THE PREFERRED EMBODIMENT

These and other objects and features of the invention will appear from the following written description and the drawings, in which.

Figure 1:
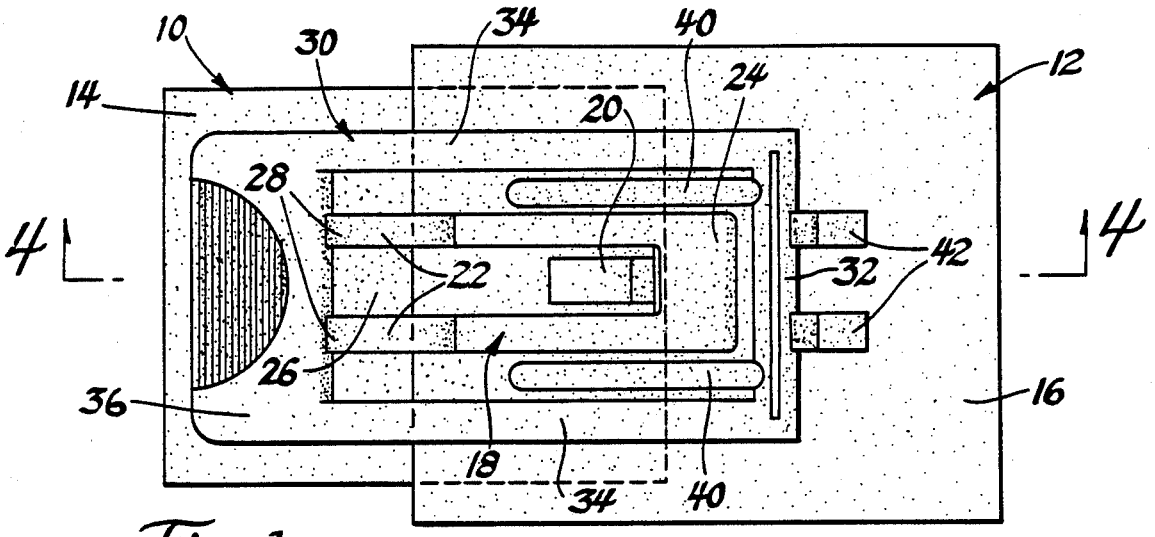
FIG. 1 is a plan view of the fully mated connector bodies, showing both locking arms engaged.

Referring first to FIG. 1, first and second connector bodies, designated generally at 10 and 12, are molded of plastic or other insulating material in a general box shape. Connector bodies 10 and 12 each have an upper planar surface 14 and 16 respectively, and are sized so that connector body 10 can be pushed inside connector body 12, which brings surface 16 over surface 14, generally parallel thereto, as shown. This position may be defined as the fully mated position of the connector bodies 10 and 12, and it is the position where internal electrical terminals, not shown, would be in contact with one another. In order to be sure of electrical contact, it is desirable both that the fully mated position be assured, and that it be maintained. The preferred embodiment of the invention, described next, provides that assurance with a simple, compact and easy to operate structure.

Figure 2:
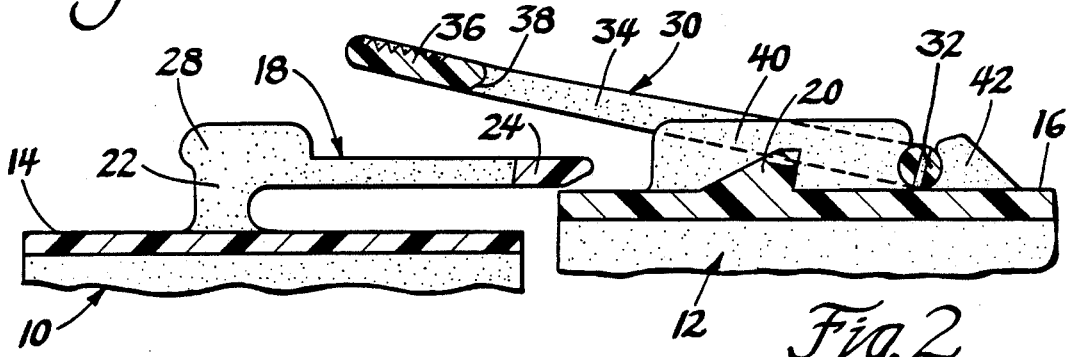
FIG. 2 is a cross sectional view of a portion of the connector bodies when they are separated.

Referring next to FIGS. 1 and 2, a primary lock means is provided by a cantilevered primary locking arm on first connector body 10, designated generally at 18, and a latching member in the form of a ramp 20 on the second connector body 12. The cantilevered locking arm 18 extends from a base 22 molded integrally to planar surface 14 to a forward latching end 24, and has a central window 26 therein. Cantilever arm 18 is flexible about base 22 upwardly from its free state, generally parallel to surface 14. Base 22 further includes a pair of rounded keeper projections 28 spaced from surface 14 that extend in the opposite direction to the locking arm 18. The ramp 20 is integrally molded to surface 16, and slopes upwardly.

Figure 3:
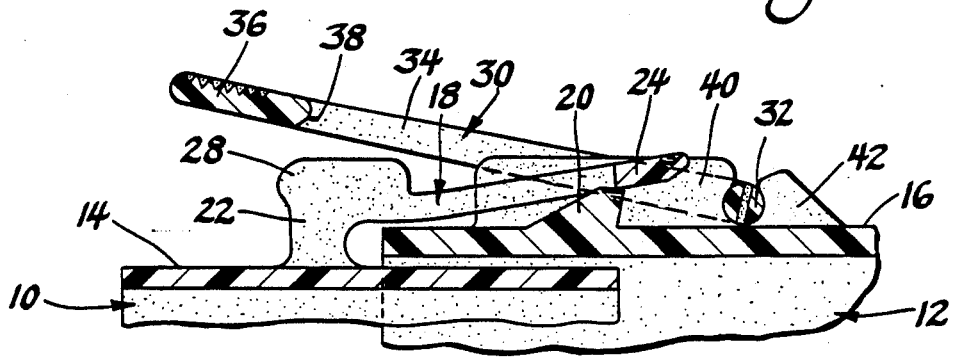
FIG. 3 is a view like FIG. 2, but with the connector bodies partially mated together.
Figure 4:
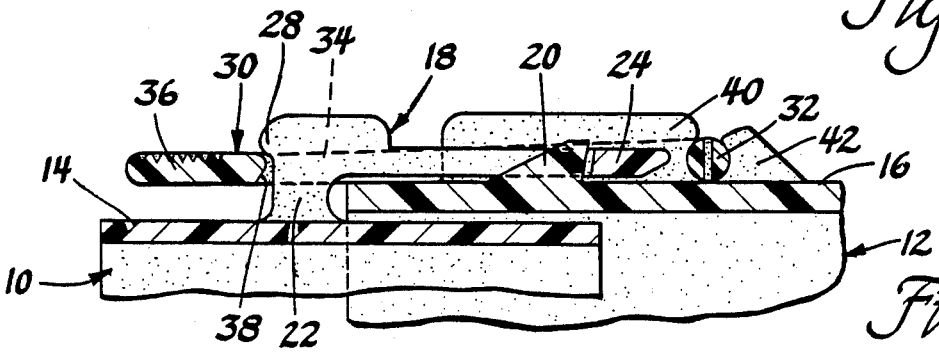
FIG. 4 is a sectional view taken along the line 4—4 of FIG. 1.

Referring next to FIGS. 3 and 4, when the connector bodies 10 and 12 are pushed together, the cantilever locking arm forward end 24 slides along and up the sloped surface of the ramp 20, which flexes the arm 18 upwardly from its free state, as seen in FIG. 3. As the connector bodies 10 and 12 reach their fully mated position of FIG. 4, the locking arm forward end 24 moves completely past the ramp 20 and within the window 26, and arm 18 flexes back down to its free state. Arm forward end 24 is then blocked from moving back by ramp 20, providing a primary lock to prevent the connector bodies 10 and 12 from being pulled apart. Should the connector bodies 10 and 12 be only partially pushed together, however, as in FIG. 3, the locking arm forward end 24 will rest on the ramp 20, and the primary lock will not be fully engaged. This may occur because of the resistance of the internal terminals to slide together, and is exacerbated if the assembly location is blind or inaccessible, as may often be true in an automobile. Without more, there is nothing to assure or indicate that the fully mated position has in fact been reached, and nothing to back up the primary lock arm 18, even if it is fully engaged. Furthermore, without more, the lock arm 18 is relatively unprotected, exposed above the surfaces 14 and 16.

Referring again to FIGS. 1 and 2, a secondary lock means cooperable with the primary lock means assures that the connector bodies 10 and 12 are properly and fully mated, and provides a double locking feature. A secondary locking arm, designated generally at 30, has generally a rectangular frame shape, with a cylindrical pivot 32, a pair of side rails 34, and a camming end 36 that interconnects the side rails 34. Camming end 36 has an inner sloped surface 38, and pivot 32 is slotted, for a purpose described below. Although moldable as a separate single piece, secondary locking arm 30 does not have to be handled separately from connector body 12, but is pivoted thereto. Integrally molded with surface 16 are a pair of guide walls 40 that are parallel to ramp 20 and to one another, and which are spaced apart slightly greater than the width of primary locking arm 18, but slightly less than the separation of the side rails 34. Guide walls 40 are each higher than ramp 20 with top edges and front edges that are slightly rounded, and with a rear edge formed into a half circle. Also integrally molded to surface 16 are a pair of lugs 42 with front edges formed into half circles, which face the rear edges of guide walls 40 and are spaced therefrom by approximately the diameter of pivot 32. Lugs 42 are parallel to each other and to guide walls 40, but are located between them. This location and orientation of ramp 20, guide walls 40 and lugs 42 allows the entire connector body 12 to be by-pass molded, that is, molded by a single pair of mold elements that part along a straight line. Pivot 32 is snapped between between the facing rear and front edges of guide walls 40 and lugs 42 respectively, which thereby cooperatively provide a rotatable connection of secondary locking arm 30 to second connector body 12. The fact that pivot 32 is slotted gives it the resilience to easily snap in place. However, the fit of pivot 32 is tight enough that secondary locking arm 30 will stay in the up position of FIG. 2, or even higher, unassisted. Guide walls 40 also provide other advantages, as will be described below.

Referring again to FIG. 3, the operation of the secondary lock means, which does not affect the independent operation of primary locking arm 18, but cooperates therewith, may be understood. As the connector bodies 10 and 12 are pushed together, primary locking arm 18 moves between the guide walls 40, which will serve to bump arm 18 into proper alignment if the connector bodies 12 and 14 are not exactly aligned. For purposes of illustration, it will be assumed that the connector bodies 12 and 14 are only partially mated, and that the primary locking arm forward end 24 is therefore resting on ramp 20, as shown. This fact may not be readily apparent to the assembler/operator in a cramped and blind location. Since secondary locking arm 30 is not separate from connector body 12, it may be easily rotated by an operator about the pivot 32 by pushing the camming end 36 down, which can be done by feel only and with one hand only. The operator need only get a fingertip grip beneath one or the other of the connector bodies 10 or 12, and push down on the camming end 36 with a thumb. As the secondary locking arm 30 is so rotated, its side rails 34 can engage the rounded top edges of the guide walls 40, which will serve to guide arm 30 as it rotates down. In fact, if arm 30 starts from a higher up position, then the engagement of side rails 34 with the rounded top edges of guide walls 40 can bump arm 30 over into proper alignment, if pivot 32 was not snapped into an exactly centered location. Eventually, the camming end surface 38 engages the rounded keeper projections 28, which have enough mutual overlap that they will slide past one another under pressure, and the first connector body 10 will thus be drawn toward the second connector body 12.

Referring next to FIG. 4, continued downward pressure on camming end 36 assures that the connector bodies 10 and 12 reach the fully mated position shown and that the primary locking arm forward end 24 slides completely over ramp 20. Continued pushing on the camming end 36 then snaps it beneath the keeper projections 28 to indicate to the operator by feel and sound that the connector bodies 10 and 12 have in fact reached the fully mated position. Should the connector bodies 10 and 12 be so far apart that the camming end surface 38 does not overlap the rounded keeper projections 28, then the camming action will not occur, and the operator will be alerted by the fact that the snap fit does not occur, either. The snap fit of camming end 36 beneath the keeper projections 28 also serves to capture the primary locking arm base 22 behind the camming end 36. This provides a second or double lock to retain the connector bodies 10 and 12 together, with no additional structure. Furthermore, the primary locking arm 18 is located between the guide walls 40, so that it is protected for the length of the guide walls 40. The fact that the secondary locking arm side rails 34 are spaced apart as they are puts them outboard of the guide walls 40 and the primary locking arm 18, with both locking arms 18 and 30 located close to an parallel to the surfaces 14 and 16. This gives a compact, low profile design, and also provides further protection to the primary locking arm 18.

Variations of the preferred embodiment may be made within the spirit of the invention. Different forward ends on the primary locking arm 18 and different latching members on the second connector body 12 could be used. For example, a primary locking arm 18 with a hooked forward end that snapped beneath a bar on second connector body 12 would provide the same type of primary lock, and would be subject to the same partial engagement if the connector bodies 10 and 12 were not fully mated. A secondary locking arm 30 that did not have the spaced side rails 34, but which was instead located above the primary locking arm 18 after being pushed down, would provide the same position assurance feature, but would not be as compact or low profile. Likewise, the guide walls 40, if eliminated, would not detract from the compactness of the design, so long as the side rails 34 were spaced apart far enough to allow the primary locking arm 18 to nest between them. However, the guide walls 40 cooperatively provide part of the rotatable connection to secondary locking arm 30, they provide guidance and protection to primary locking arm 18, and they provide guidance to secondary locking arm 30, all in an easily molded and low profile design. Therefore, it will be understood that patent protection is not intended to be limited to just the preferred embodiment disclosed.

The embodiments of the invention in which an exclusive property or privilege is claimed are defined as follows:

1. In combination with first and second electrical connector bodies that are movable together from a separated to a fully mated position, a cooperating primary and secondary lock means to assure that the connector bodies reach the fully mated position and to provide double locking between the connector bodies, comprising, a cantilevered primary locking arm on the first connector body extending from a base, said base further including a keeper projection extending in the opposite direction to said locking arm, a latching member on the second connector body with which said primary locking arm engages as said connector bodies are moved to the fully mated position, thereby providing a primary lock between said fully mated connector bodies, said arm remaining only partially engaged with said latching member when said connector bodies are only partially mated, and, a secondary locking arm on the second connector body extending from a pivot to a forward camming end, said secondary locking arm being being rotatable about said pivot by pushing said camming end toward said second connector body, thereby engaging said camming end and said keeper projection to move said first connector body toward said second connector body, when said connector bodies are only partially mated, and thereby assure that said primary locking arm becomes fully engaged with said latching member, whereupon said camming end snaps beneath said keeper projection to indicate that said connector bodies have reached the fully mated position, said camming end also serving to capture said primary locking arm base, whereby a double lock between said connector bodies is cooperatively provided.

2. In combination with first and second electrical connector bodies that are movable together from a separated to a fully mated position, a cooperating primary and secondary lock means to assure that the connector bodies reach the fully mated position and to provide double locking between the connector bodies, comprising, a cantilevered primary locking arm on the first connector body extending from a base to a forward end, said base further including a keeper projection extending in the opposite direction to said locking arm, a latching member on the second connector body past which said locking arm forward end slides as said connector bodies are moved to the fully mated position, thereby providing a primary lock between said fully mated connector bodies, said arm forward end resting on said latching member when said connector bodies are only partially mated, and, a secondary locking arm on the second connector body including a pair of side rails spaced apart greater than the width of said primary locking arm and extending from a pivot to a forward camming end, said secondary locking arm being rotatable about said pivot by pushing said camming end toward said second connector body, thereby engaging said camming end and keeper projection to move said first connector body toward said second connector body, when said connector bodies are only partially mated, and thereby assure that said arm forward end slides past said latching member, whereupon said camming end snaps beneath said keeper projection to indicate that said connector bodies have reached the fully mated position, said camming end also serving to capture said primary locking arm base with said primary locking arm located between said spaced side rails, whereby a low profile double lock between said connector bodies is cooperatively provided.

3. In combination with first and second electrical connector bodies that are movable together from a separated to a fully mated position, a cooperating primary and secondary lock means to assure that the connector bodies reach the fully mated position and to provide double locking between the connector bodies, comprising, a cantilevered primary locking arm on the first connector body extending from a base to a forward end, said base further including a keeper projection extending in the opposite direction to said locking arm, a ramp on the second connector body over which said locking arm forward end slides as said connector bodies are moved to the fully mated position, thereby providing a primary lock between said fully mated connector bodies, said arm forward end resting on said ramp when said connector bodies are only partially mated, a pair of generally parallel guide walls on said second connector body between which said primary locking arm slides as said connector bodies are mated, and a secondary locking arm on said second connector body including a pair of side rails spaced apart slightly greater than said parallel guide walls and extending from a pivot to a forward camming end, said secondary locking arm being rotatable about said pivot by pushing said camming end toward said second connector body, thereby engaging said camming end and keeper projection to move said first connector body toward said second connector body, when said connector bodies are only partially mated, and thereby assure that said latching end slides over said ramp, whereupon said camming end snaps beneath said keeper projection to indicate that said connector bodies have reached said fully mated position, said camming end also serving to capture said primary locking arm base with said primary locking arm located between said guide walls and with said secondary locking arm side rails located outboard of said guide walls, whereby a low profile double lock between said connector bodies is cooperatively provided with said guide walls and said side rails providing protection for said primary locking arm.

* * * * *